United States Patent [19]

Burke et al.

[11] 4,303,387

[45] Dec. 1, 1981

[54] ENAMELED WIRE OVEN

[75] Inventors: Richard E. Burke, Hixson, Tenn.; Edward H. Harris, Kissimmee, Fla.

[73] Assignee: Hudson Wire Company, Trenton, Ga.

[21] Appl. No.: 214,587

[22] Filed: Dec. 9, 1980

[51] Int. Cl.[3] ..... F27B 9/28

[52] U.S. Cl. ..... 432/72; 432/59

[58] Field of Search ..... 432/8, 59, 72

[56] References Cited

U.S. PATENT DOCUMENTS

| | | | |
|---|---|---|---|
| 2,804,694 | 9/1957 | Clipsham | 432/72 |
| 2,921,778 | 1/1960 | Ruff | 432/8 |
| 3,106,386 | 10/1963 | Harris | 432/8 |
| 3,183,604 | 5/1965 | Stauffer | 34/18 |
| 3,183,605 | 5/1965 | Arque et al. | 432/49 |
| 3,265,033 | 8/1966 | Touze et al. | 432/48 X |
| 3,351,329 | 11/1967 | Thomas | 432/72 |
| 3,810,736 | 5/1974 | Dumas | 432/8 |

*Primary Examiner*—John J. Camby

*Attorney, Agent, or Firm*—Alan Ruderman

[57] ABSTRACT

A recirculating oven having dual air plenum chambers each controlled by an individual blower receiving air and oxidized gases from a burner tube intermediate the plenums. The gases leaving the burner tube are drawn by the blowers into the respective plenum and enter a pair of evaporation zone modules at the bottom of the plenums and a curing zone module at the top are fed into a pair of wire work chambers, both air streams mixing between the zones and return with volatile fumes through a return module to a burner mounted in the upper portion of the burner tube which receives the mixture in a swirling fashion from a vortex generator between the tube and burner. The burner tube is mounted within a burner tube housing partitioned so that the volatile fumes returning to the burner are maintained separately from the oxidized gases and air exiting from the burner tube. The wire work chambers are formed in a recess between oven access doors and the oven box and can be increased for larger size wires by positioning inserts between the door and the oven.

14 Claims, 8 Drawing Figures

ENAMELED WIRE OVEN

BACKGROUND OF THE INVENTION

The present invention relates to ovens and more particularly to an oven for processing coated wire to evaporate and cure the solvents and other volatile components present in the coating material.

Wire for many electrical applications is generally coated with a thin film of insulating material such as oleoresinous enamel. The coating material is dissolved or suspended in a liquid solvent or carrier and the wire is dipped into this bath to obtain an even coating. Consequently, a wet film is present on the wire which thereafter is passed through an oven to evaporate the solvent or carrier and to cure the remaining solid coating material.

It has been known for some time that separate control of the evaporation and curing processes is required to obtain wire at a high processing volume with good results. To this end the prior art ovens provide separate evaporating and curing zones, the wire first passing through the evaporating zone and heated by gas enter adjacent the wire inlet, and then through the curing zone and heated by gas entering adjacent the wire outlet the gas exiting the work chamber through a common outlet between the zones. Since obnoxious, if not noxious, vapor and fume from the solvent are released by the process, the gases leaving the zones are recirculated and routed to a catalytic burner or to a high temperature burner for a sufficient period of time to oxidize the volatile vapors and fumes. Ovens utilizing the catalytic oxidizer are illustrated in U.S. Pat. Nos. 3,351,329 (Thomas); 3,183,605 (Argue et al); 3,183,604 (Stauffer); 3,106,386 (Harris); 2,921,778 (Ruff) and 3,265,033 (Touze et al). An example of an oven constructed with a non-catalytic oxidizer is illustrated in Dumas U.S. Pat. No. 3,810,736.

The constructions of these prior art ovens, however, have a number of limitations. For example, the known ovens have been constructed as integral units, i.e. the framework, wall structures, door closures, partitions and ducting etc. have been built, and welded together as a unit. Thus, large amounts of heat are transferred from the hot internal sections to the outer skin. Over a period of time as expansion and contraction of the hot sections occur large amounts of distortion resulting in failure of certain of the elements have required the rebuilding of the entire oven.

Another and related deficiency of the prior art ovens is a lack of flexibility to accommodate wires of largely varying sizes. The wires move through a passageway or work chamber confined between fixed structural members. Generally, the work chamber can accommodate a range of wire sizes, but the range is limited. Thus, if a wire of a greatly different size is to be processed either a new oven is required or the existing oven must be disassembled and rebuilt to the new size range.

A further limitation of the ovens in the prior art is their inability to process different size or differently coated wires simultaneously. The optimum temperature profile through the evaporation and curing zones varies with wire size and coating types so that the simultaneous processing of more than one size or coating type is not practicable with the known ovens of the prior art.

SUMMARY OF THE INVENTION

The present invention provides an enameling oven having a modular construction. The framework comprises structural beam members such as angle members, channel members etc. and is completely self supporting. Once the framework is assembled the outer skin comprising steel sheets is secured thereto and insulation is attached to the outer skin with metal pins. The inner structure comprising the burner box, air plenum chambers, air distribution passageways and return air passageway are individually manufactured as modules and assembled into the framework with a minimum of contact with the outer structure to minimize the transfer of heat outwardly. This construction not only provides a greatly simplified oven with less heat loss, but also allows the internal parts to expand and contract with a minimum of distortion.

One important feature of an oven constructed in accordance with the principles of the present invention is that of the door closures which are constructed to have a minimum contact with the structural framework and is recessed to provide a cavity between the oven housing and the door panels. The wire passageways or work chambers are disposed within the recessed cavity. This construction allows for variations in wire size by the utilization of spaces between the connecting surfaces between the door and oven box thereby allowing standardization of the oven for various wire sizes and a versatility heretofore unknown. Moreover, should distortion of the door closures occur the doors can be removed for repair or replacement without requiring the disassembly of any of the remaining oven structure and without requiring the removal of wire being processed.

Another important feature of the present invention is the provision of dual air plenum chambers each having a separate blower for receiving the heated gases from the burner through a common supply chamber, each blower being separately controlled so that each air plenum chamber is independent of the other. With this construction the coating and processing of wires having different sizes and coating types can be processed simultaneously. An equalization tube having a balancing valve interconnects the two air plenum chambers to balance the pressures when desired and each plenum chamber has a short circuit valve for diverting air back to the burner chamber to conserve energy when the heat requirement in one plenum is exceeded by the air supply. By varying the blower speed and by proper adjustment of the valves a temperature profile can be obtained to permit the simultaneous processing of different wire sizes and coating types.

Another feature of the present invention is the provision of a separate air lock system at the exit of the wires of the oven to prevent fumes, smoke and volatile gases from exiting through the wire exit space. Each air lock includes a blower that directs cool outside air into a channel at a higher pressure than the gases within the work chamber at the wire exit in a manner similar to that disclosed in the aforesaid Argue et al U.S. Pat. No. 3,183,605, but is an improvement thereover. Air baffle plates distribute the incoming air substantially equally over the wire work chamber at the exit portion thereof and may include provision for cooling of the entering pressurized air stream. Moreover each air lock blower is independently controlled to vary the air supplied to the air lock to maintain a proper temperature of the mixture of the air lock air stream with the wire carrying air stream so that the air flow in the air plenums is not effected.

Another important feature of the present invention is the provision of a gas fuel burner having recirculated gas openings for receiving a recirculated fume and volatile gas carrying air stream and which is mounted within a housing having diffuser vanes that impart a vortex type swirling pattern to the recirculated gases as the gases are directed back to the burner. The swirling gases are thus maintained for a longer period of time in contact with the burner housing and within the burner so that the volatile fumes and gases are substantially incinerated. The time of exposure to the combustion temperatures determines the efficiency of the unit and the cleanliness of the exhaust gases, the construction providing a highly efficient system. The burner is mounted within the vaned housing and adjustable axially relatively to the vanes so that the pressure drop in the burner and the amount of solvent laden air subjected to direct incineration can be varied as required.

Thus an oven constructed in accordance with the principles of the present invention is a recirculating oven having dual air plenum chambers each controlled by an individual blower receiving clean air from a combustor section intermediate the plenums. The gases which leave the combustor section at the bottom of an elongated burner tube, the burner being of a truncated conical configuration at the top of the tube, are drawn by the blowers into the respective plenum and enter a pair of evaporation zone modular supply duct assemblies at the bottom of the plenums and a curing zone modular supply duct at the top thereof. The coated wire enters at the bottom of the work chamber between a recess in access doors and the oven box, and exits at the top through the air locks. The air is directed to flow concurrently with the wire in the evaporation or drying zone and in the reverse direction to the wire movement in the curing zone. Both air streams mix in a modular return air interchange intermediate the wire entry and exits. The air in the interchange carrying the fumes and volatile solvent gases is directed back about the burner tube into a vaned housing which imparts a swirling motion to the gases which are directed back and enter holes in the burner for incineration while still swirling during the combustion process. The burner tube is mounted with a partition such that the returning volatile fumes are maintained separately from the oxidized gases, the latter being mixed with fresh temperature controlling air prior to entry into the plenum chambers, an equal amount of clean mixed air and oxidized gases being exhausted from the plenums.

Consequently it is a primary object of the present invention to provide a high production oven for drying and curing coated wire which permits processing of a large number of differing wire sizes.

It is another object of the present invention to provide an oven for drying and curing coated wire which can process different wire sizes and/or coating types simultaneously.

It is a further object of the present invention to provide an oven for drying and curing coated wire constructed and assembled in modular fashion to provide a minimum of wasted heat transfer and distortion of the structure.

It is a still further object of the present invention to provide an oven for drying and curing coated wire in which the wire work chamber is within a cavity defined by the access doors and oven box and which chamber can be varied merely by the addition of spacer members between the doors and the oven box.

It is a yet still further object of the present invention to provide an oven for drying and curing coated wire in which a pair of dual air plenum chambers are provided and supplied by a single burner section, each plenum being individually controlled for processing of differing wires simultaniously in work chambers receiving air from the plenums.

It is still another object of the present invention to provide an oven for drying and curing coated wire having a unique air lock system for preventing fumes and volatile gases from escaping the oven with the exiting wire.

It is still yet another object of the present invention to provide an oven for drying and curing coated wire in which recirculated gases are directed to a burner and burner housing constructed to expose the gases to the heat of the burner for a sufficiently long duration to oxidize the fumes and volatile gases to substantially clean exhaustable levels.

BRIEF DESCRIPTION OF THE DRAWINGS

The particular features and advantages of the invention as well as other objects will become apparent from the following description taken in connection with the accompanying drawings, in which.

BRIEF DESCRIPTION OF THE PREFERRED EMBODIMENT

Figure 1:
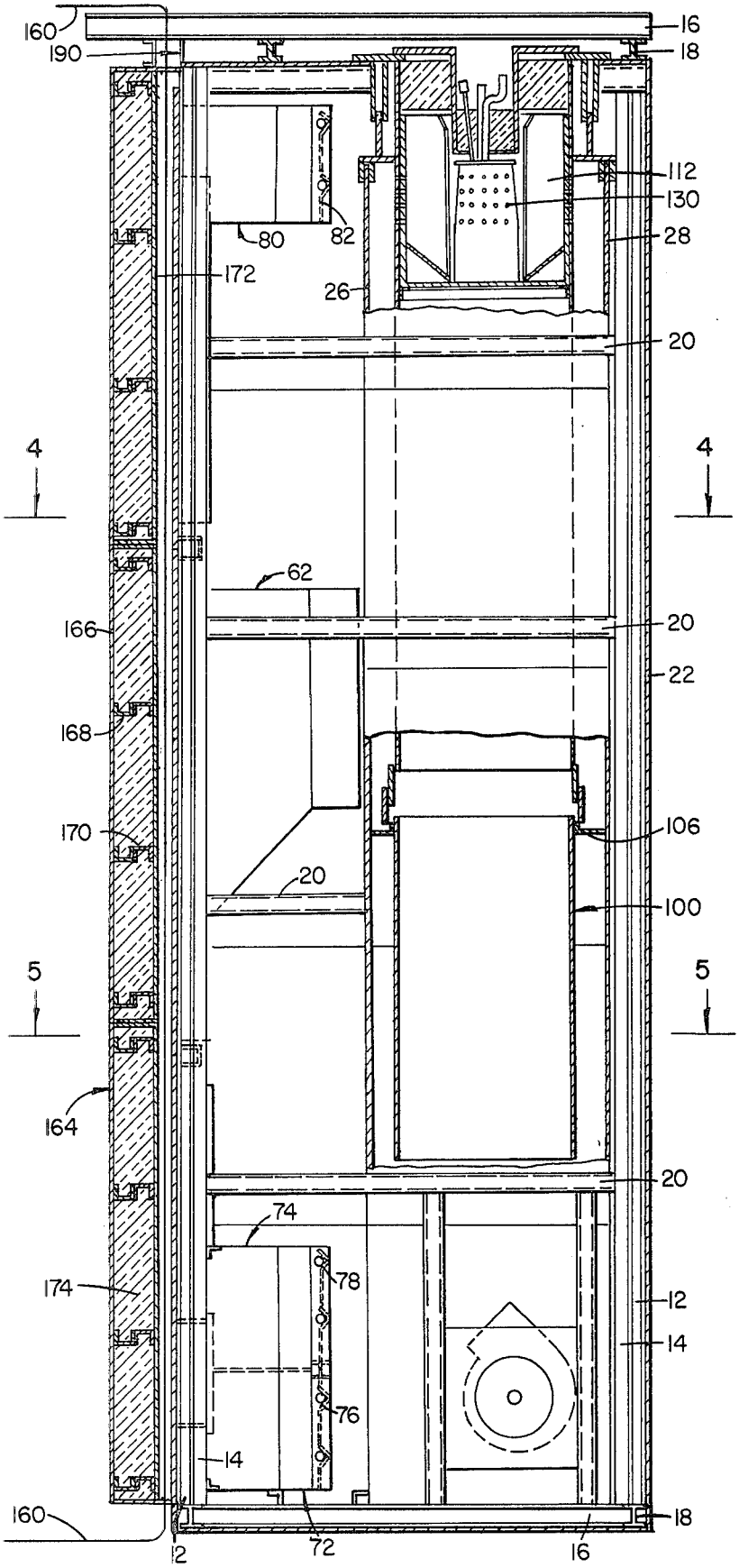
FIG. 1 is a vertical sectional view through a drying and curing oven constructed in accordance with the principles of the present invention.

An oven constructed in accordance with the present invention as illustrated in the drawings having a housing of a substantially rectangular form and comprises a structural framework including a plurality of vertically extending channel members 12 and 14 secured together at each corner and secured to structural channels and I beams 16 and 18 respectively at the top and bottom thereof. A number of vertically spaced channel members 20 are secured to and connect adjacent channels 14 to provide a rigid structural skeletal framework. Positioned and secured to the outer surfaces of the framework about the entire framework of the oven with the exception of the wire work chamber is an outer skin 22 comprising sheet steel. Similarly, an outer skin 23 forms the top surface of the oven. Insulation comprising two layers of mineral fiber are positioned against the interior of the outer skin and an additional layer of rigid ceramic fiber board and an inner skin of stainless steel are serially disposed on the mineral fiber and secured to the outer skin with metal pins. The framework together with the wall structure comprises a rigid casing within which a number of modular elements are disposed.

Figure 2:
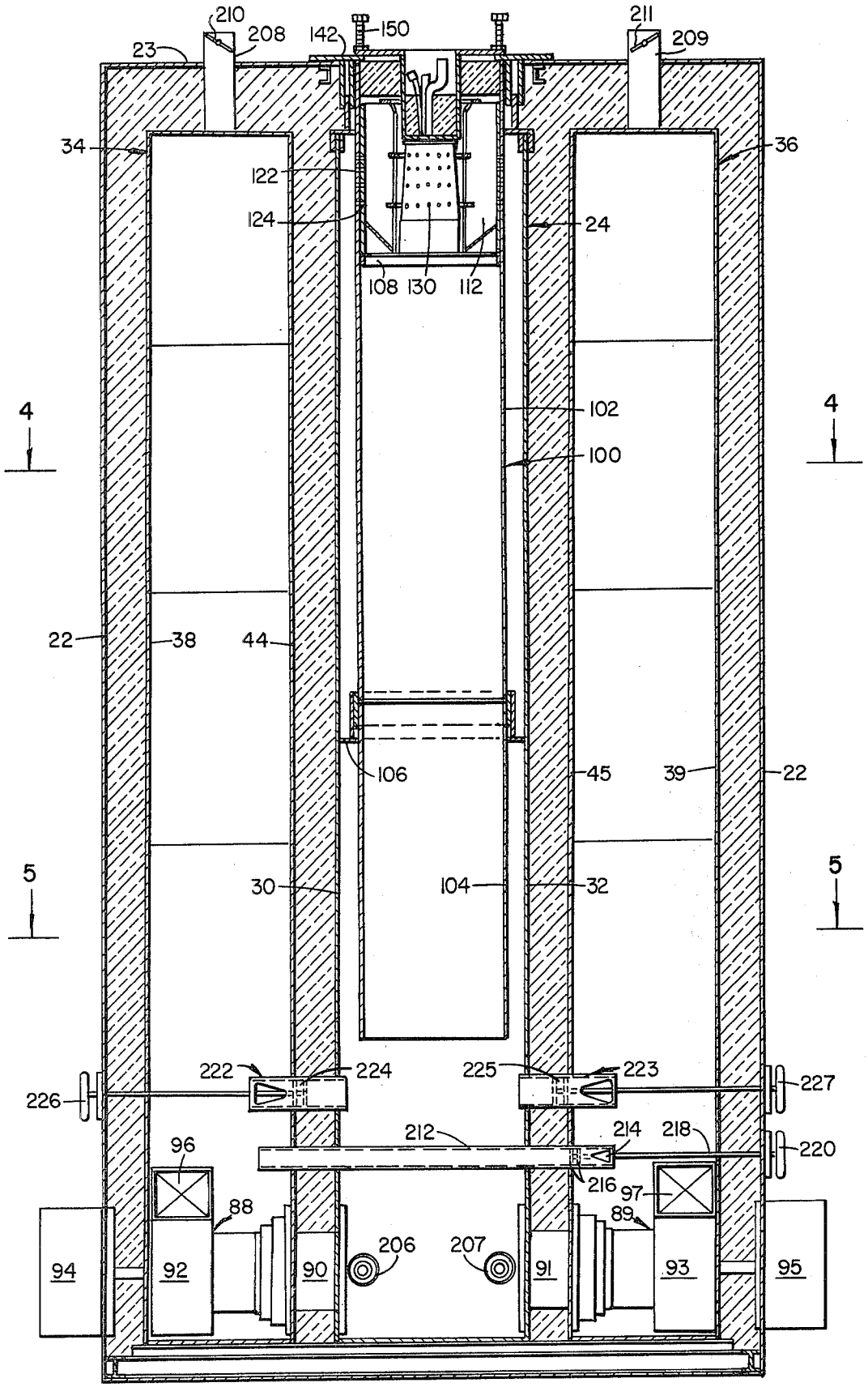
FIG. 2 is a vertical sectional view taken substantially along line 2—2 of FIG. 4.
Figure 5:
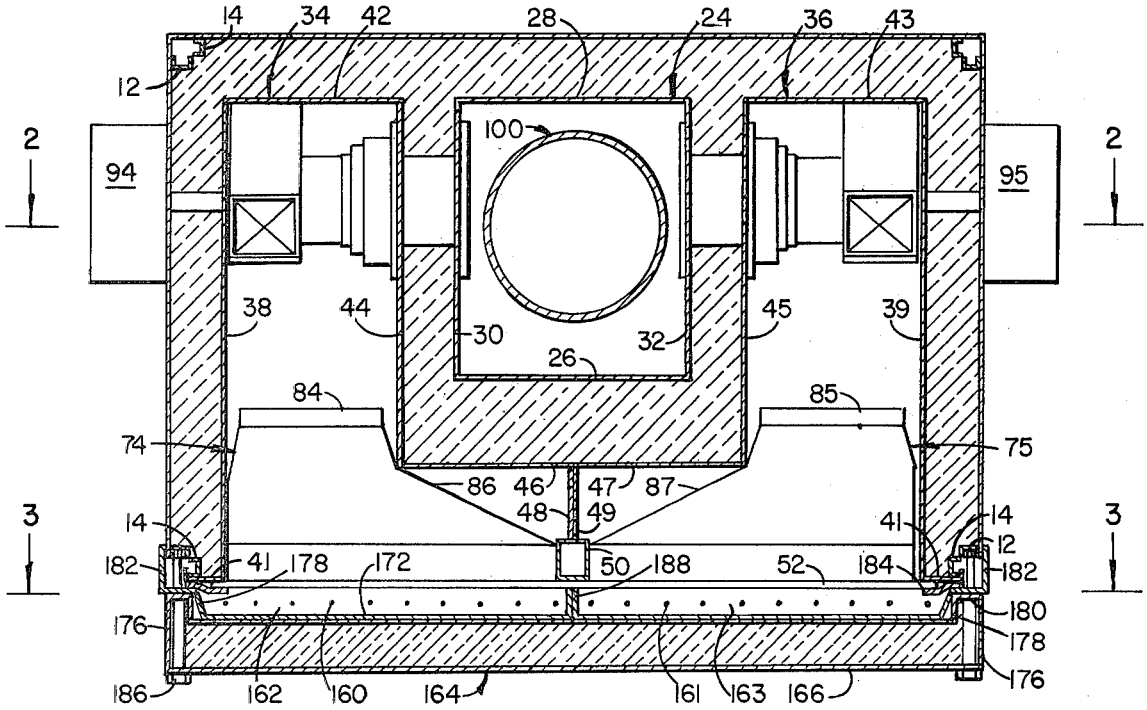
FIG. 5 is a horizontal sectional view taken substantially along line 5—5 of FIG. 2.

The oven is of a substantially modular construction with the internal components positioned within the casing with a minimum of contact with the outer structure. Thus, positioned within the oven casing in a substantially central location is a burner tube box generally indicated in FIG. 2 at 24 and having a substantially rectangular cross sectional configuration as best illustrated in FIG. 5 including front and rear walls 26, 28 respectively and sidewalls 30 and 32. The burner tube box 24 is constructed of a number of sections of sheet steel bent into the proper configuration and assembled to each other vertically. Disposed at each side of the burner tube box is a respective right and left air chamber 34, 36, each constructed of a number of sections of sheet steel secured together to form a vertically elongated air plenum. Each air chamber 34, 36, as best illustrated in FIGS. 2 and 5, comprises an upstanding outer sidewall 38, 39 respectively having an outwardly extending lip 40, 41 attached out its outer edge to the adjacent corner channel member 14. At the rear of the air chambers the walls 38, 39 have a wall portion 42, 43 extending inwardly toward the burner tube box 24 and terminates in a wall 44, 45 that extends from the respective wall 42, 43 forwardly toward another wall section 46, 47 directed inwardly toward the center line of the burner and terminating in a short wall section 48, 49. The front edge of each of the walls 48, 49 are secured to a vertically extending elongated box beam 50. A plate 52 is secured to the front edges of the channel members 14 and the front surface of the beam 50 to define the rear closure of a work chamber, hereinafter described. Consequently, it can be seen that each of the air chambers 34, 36 and the burner tube box 24 is disposed within the oven casing as a modular free standing unit and secured to the framework at a minimum number of locations. This provides for ease of assembly and minimizes the heat transferred from the hot internal sections of the oven to the outer skin thereby minimizing wasted energy.

Figure 3:
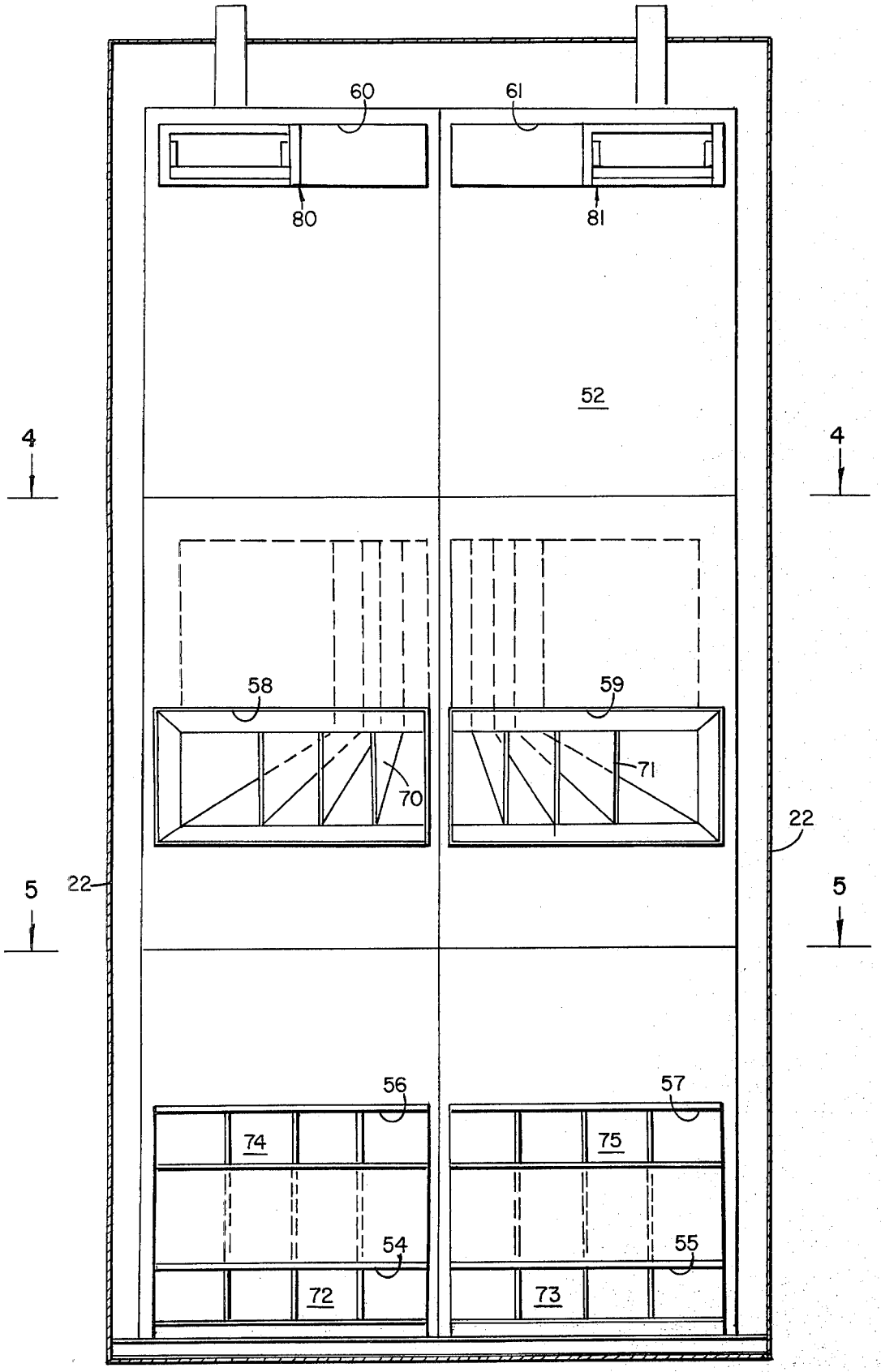
FIG. 3 is a sectional view taken substantially along line 3—3 of FIG. 4.

Formed through the plate 52 at each side of the beam 50 are four spaced openings 54, 56, 58, 60 and 55, 57, 59, 61, best illustrated in FIG. 3. One of the openings on each side of the beam, these being openings 58 and 59, is located at substantially the vertical medial portion of the plate 52 and a return or recirculated air module 62, 63 is secured to the plate in communication with the respective opening. Each return module 62, 63 is of a substantial horn shaped configuration having a respective smaller outlet section 64, 65 disposed and secured within a hole in the wall 26 of the burner tube housing, the return modules having a substantially planar side wall 66, 67 adjacent the air chamber walls 48, 49 and flared side walls 68, 69. Air foil shaped vanes 70, 71 are disposed within the respective return module for smoothly increasing the velocity of the return gases from the openings 58, 59 to the burner tube housing 24 as hereinafter described. Evaporation zones supply modules 72, 74 and 73, 75 are positioned within the lower section of the respective air chamber housing 34, 36 and have frontal openings positioned and secured to the plate 52 for communicating the air chambers with the respective openings 54, 55, and 56, 57. Each module 72, 73 and 74, 75 has a respective set of pivotably mounted dampers 76, 78 externally moveable to control the supply of air each module delivers. Another pair of supply modules, these being curing zone modules 80, 81 similar to the evaporation zone modules, are positioned within the upper section of the respective air chamber housings 34, 36 and include dampers 82 similar to dampers 76, 78. Each supply module as illustrated in FIG. 5 with regard to the evaporation zone modules 74 and 75 has a smaller inlet section 84, 85 to reduce the velocity of the supply air into the wall chamber, and has a side wall shaped to fit about the respective air chamber wall 45, 46 flaring outwardly at 87, 88 as illustrated. As best seen in FIG. 1 all of the supply modules preferably have substantially planar upper and lower surfaces for ease of construction although the exact configuration of the modules can be varied without departing from the spirit of the present invention.

Positioned within each air chamber 34, 36 is a respective centrifugal blower assembly 88, 89 including air ducts 90, 91 extending through the wall of the respective chamber into communication with the burner tube housing 24. Each of the ducts 90, 91 is connected to the inlet of a respective conventional centrifugal blower 92, 93 driven by a respective motor 94, 95. Each blower 92, 93 has a respective outlet 96, 97 disposed within the corresponding air chamber 34, 36 for circulation of the working gas from the burner tube box to the respective evaporator zone and curing zone supply modules as will be clearly understood hereinafter. It should be understood that each motor 94, 95 may be individually controlled to vary the blower speed and thus the flow rate of gas delivered by each blower to the respective air chamber.

Mounted within the burner tube box 24 is a substantially cylindrical elongated burner tube 100. The burner tube preferably comprises a pair of tubular sections, the upper section 102 being secured to the lower section 104. At the junction of the sections the burner tube extends through and is connected to a substantially horizontal plate 106 extending between the four walls of the burner tube box 24 to divide the burner tube box into a lower or outlet section below the plate and an upper or return section above the plate, the plate acting to seal the sections from one another. As illustrated in FIG. 1 the opening into which the outlet of the return module 62 and 63 extend is above the plate 106 and the inlets to the blowers 92, 93 are below the plate 106.

Figure 6:
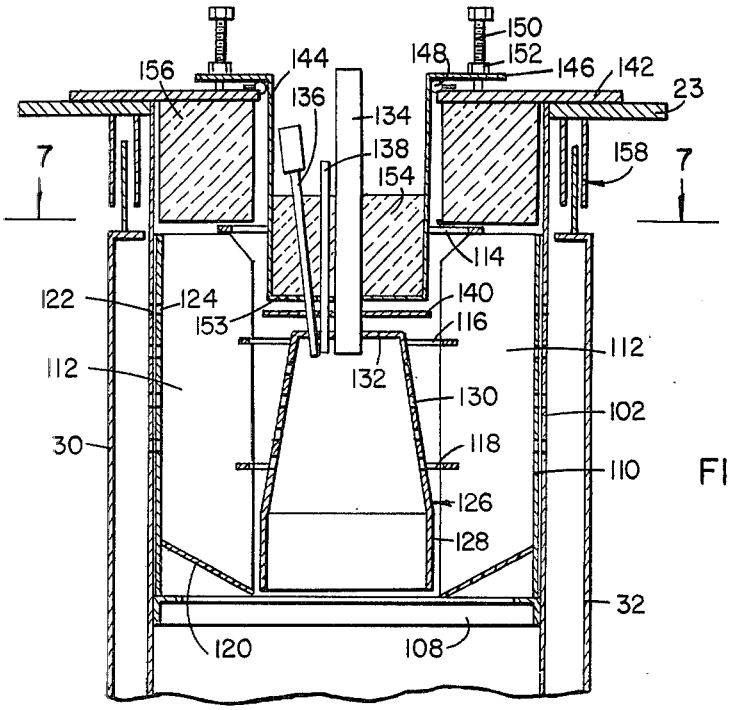
FIG. 6 is an enlarged sectional view taken substantially through the burner portion of the oven illustrated in FIG. 1.
Figure 7:
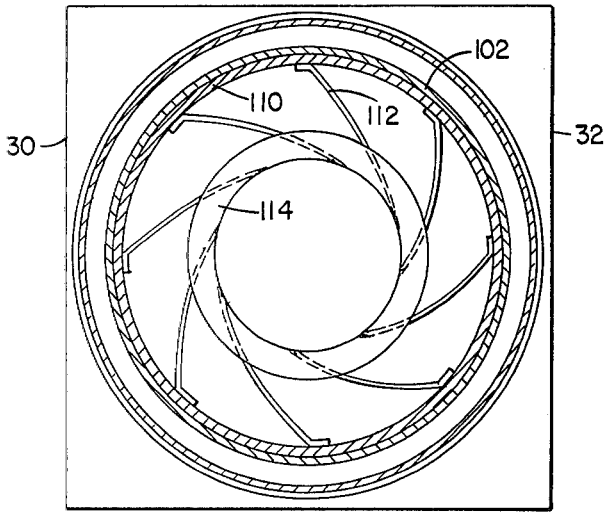
FIG. 7 is a sectional view taken substantially along line 7—7 of FIG. 6.

As best illustrated in FIG. 6, a ring shaped angular member 108 is welded into the burner tube at the upper part of the section 102 and supports a vane housing or shell 110. The shell is a substantially cylindrical member having a plurality of vertically elongated spirally arcuate vanes 112 fixed to the inside peripheral surface extending inwardly in a manner like a centrifugal turbine vane toward the tangent of a circle. A top ring 114 and a pair of central rings 116, 118 add structural rigidity to the vanes which have an angular bottom configuration secured to a conical rim 120 which in turn is secured to the shell 110. Both the burner tube section 102 and the shell 110 have a plurality of holes 122, 124 about the periphery thereof for passing the recirculated gases within the burner tube housing 24 returned from the return module 62, 63 inwardly as directed by the vanes. Positioned within the vane shell in the space defined by the inner circle of the vanes is the burner 126 which has an upwardly extending truncated conical configuration with a cylindrical collar 128 at the bottom. The burner has a plurality of variously sized holes 130 spaced about the periphery so that the swirling recirculated gases can enter the interior of the burner and be incinerated and oxidized. The burner is secured at its upper surface 132 as by welding to a gas fuel inlet pipe 134 and to a spark igniter tube 136 and an ultra violet scanner tube, the pipe and tubes extending out the oven and connected to flexible extentions (not illustrated). A radiation shield 140 is also secured to the inlet pipe and tubes above the burner to minimize radiation of heat away from the burner.

Mounted on the top skin 23 of the oven above the burner tube box is an annular ring 142. A basket-like member 144 having a flanged rim 146 is disposed within the annulus of the plate 142 and extends downwardly to just above the shield 140, the rim 146 being disposed about the annulus above the plate on an air seal 148 positioned on the plate. Threaded into the rim 146 are a number of screws 150 each having a stop nut 152. The basket 144 has a bottom plate 153 welded to the pipes 134, 136, 138 and a plug of insulation 154 is positioned within the lower portion thereof. An annular ring of insulation 156 is positioned about the basket and rests on the upper vane ring 114, and a labyrinth wall seal 158 comprising vertical ribs on the oven top 23 and the top of the burner tube housing is disposed about the end of the burner tube section 102. With this construction the burner 126 can be vertically adjusted axially within the shell 110 by rotation of the screws 150 and locked in place by the nuts 152. This allows the pressure drop in the burner to be varied by positioning the burner relatively to the swirling gases fed by the vanes and thereby allows variation in the amount of solvent laden gas incinerated.

Figure 4:
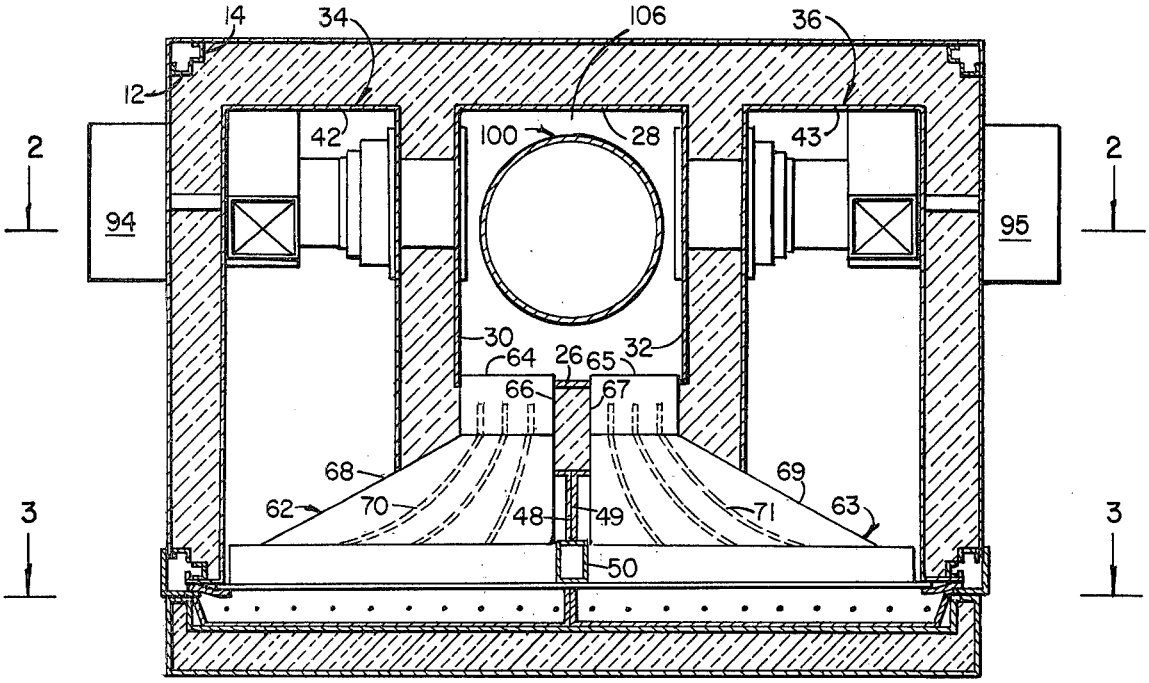
FIG. 4 is a horizontal sectional view taken substantially along line 4—4 of FIG. 2.

Referring now to FIGS. 1, 4 and 5 wire 160 and 161 is fed through respective work chambers 162 and 163 formed between the plate 52 and a door generally indicated at 164. The door 164 comprises three similar vertical panels mounted one upon the other and comprises an outer skin 166 fastened to and supported by a pair of channels 168, 170 extending toward an inner skin 172 of stainless steel. Three layers of insulation 174 of mineral fiber and ceramic fiber board are mounted between the inner and outer skins and secured thereto by metal pins in a similar manner as the walls of the oven. As illustrated in FIGS. 4 and 5 the end of the outer skin extends rearwardly at each side at 176 and the inner skin extends rearwardly at each side at 178, the frontal length of the inner skin being smaller than that of the outer skin, and the inner skin at the terminus of the side 178 extends outwardly at 180 to join the side 178 of the outer skin. Thus, a recess is formed in the door between the main frontal surface of the inner skin 172 and the plane of the end 180. The ends 180 at each side of the door abut one leg of an angle member 182 secured to the corner channel members 12 and the edge of the plate 52 with a seal 184 placed therebetween, and the doors are fastened by bolts 186 to the members 182. To increase the work chamber for larger wire sizes an insert may be placed between the edges 180 and the angle member 182. A vertical rib 188 is formed on the medial portion of the inner skin and extends rearwardly to engage the plate 52 to provide a seal between the work chambers 162 and 163, defined as the recess between the inner skin 172 and the plate 52. Consequently, the wire 160 in the work chamber 162 can be maintained at a different temperature profile condition as supplied by the blower 92 than the wire 161 in the work chamber 163 supplied by the blower 93.

Figure 8:
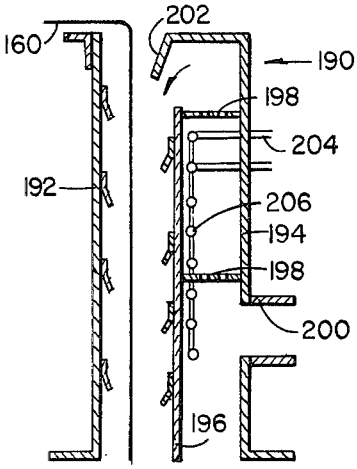
FIG. 8 is an enlarged view of the air lock illustrated in FIG. 1.

The wire enters each work chamber through the work chamber opening at the bottom of the oven and is fed upwardly through the respective work chamber. Fresh air may enter with the wire into the open space at the bottom of the work chamber, but it is desirable, if not necessary for environmental protection, to prevent the solvent laden fumes and gases from exiting through the work chamber space at the top of the oven. To this end the present invention provides a pair of air locks only one of which 190 is shown. As illustrated in FIG. 8 each air lock comprises a pair of spaced structural members 192 and 194 secured at the top of the oven the length of each work chamber, the member 192 being secured to the top of the door and the member 194 secured to the top of the oven. Although not illustrated, these members are connected together at their ends to form a substantially box shaped structure open at the top and bottom. A plate 196 also secured to the oven top spaced intermediate the members 192 and 194 and the wire passes between the plate 196 and the member 192. A pair of perforated plates 198 are secured between the plate 196 and the member 194 and high pressure fresh air from a blower (not illustrated) is fed into an inlet 200 in member 194 and spread uniformly by the plates 198 in a path between the plate 196 and the member 194. The pressure of the air supplied is greater than the pressure of the gas within the work chamber so that the air, which is directed by a downwardly extending baffle 202 flows downwardly into the space between the plate 196 and the member 192 into the work chamber and prevents the working gases from being expelled. Cold water may be fed into a pipe 204 to a heat exchanger 206 to cool the air entering the inlet 200, especially during the summer months, so that the entering air can control the upper temperature in the curing zone, the flow of entering air being controlled by a temperature sensor for regulating the blower speed. Each work chamber has its own blower to independently control the respective upper curing zone temperature.

In the rear of the lower portion of the burner tube housing 24 at the level of the blower ducts 90 and 91 are a pair of manually operable fresh air inlet ports 206, 207 for blending fresh air with the hot air received from the burner through the tube 100. The air mixture is drawn by the respective blower 92, 93 to fill the respective air chamber 34, 36 for entry into the work chamber through the evaporation and curing zone modules, an amount of the mixture substantially equal to the amount of fresh air taken in in each of the air chambers is vented outside the oven through a respective exhaust port 208, 209 having respective valves 210, 211 for controlling the amount of exhausted air which can be utilized for plant heat.

Extending from the air chamber 34 through and into the air chamber 36 is a hollow tube 212 preferably having three spaced substantially triangular openings, e.g. 214 cut into the periphery of the tube at one of the chambers. A pair of valve disks 216 secured to an elongated stem 218 is positioned within a tube and can be moved relatively to the openings by an operator 220 on the stem outside the oven wall. This tube provides a pressure balancing control between the right and left air chambers to equalize the pressure therebetween when necessary. Also disposed between each chamber 34, 36 and the burner tube box 100 is a respective short circuit valve 222, 223. Each of these valves comprises a tube 224, 225 communicating the respective air chamber with the burner tube box. Like the tube 212 each tube 224, 225 has triangular openings and disk members controlled by a respective operator 226, 227 for diverting hot air back to the burner tube box when the respective air chamber has more heat than necessary for the required temperature profile of the wire in the corresponding wire work chamber.

It can thus be understood that an oven constructed in accordance with the present invention can be utilized to dry and cure coated wire in each of two wire work chambers independently of the other chamber, thereby providing an oven having the unique capability of processing wire of two different types or sizes at the same time. Since each blower 92, 93 can be individually controlled, and since each air chamber 34, 36 has its own exhaust 208, 209 and short circuit valves 222, 223 and air lock system the flow of air and the temperature within each chamber is independent of the other work chamber. The heated gases leaving the burner flow downwardly through the burner tube into the lower portion of the burner tube housing, are drawn into the respective air chamber 34, 36 and dispersed by the respective evaporation zone supply modules 72, 74 and 73, 75 and curing zone modules 80 and 81 into the work chamber. Since each of the supply modules has its own baffle system the temperature profile across each work chamber can controllably be regulated as required by the wire being processed. Moreover since the work chambers are formed in recesses behind the door large wire sizes can be processed merely by inserting spacer elements between the angle members 182 and the abutting end 180 of the door to space the inner skin of the door further from the plate 52. Again, since the wire is behind the door if the door deforms it is merely necessary to replace the door rather than to completely rebuild the entire oven. This can even be accomplished without removing the wire.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. An oven for drying and curing coated wire and the like comprising, an outer housing including a plurality of structural members fastened together into a substantially rectangular frame and having exterior surface means fastened to the outer portions of said members, a pair of vertically elongated air chambers disposed within said outer housing spaced from each other, each air chamber including an upstanding wall means, a vertically elongated burner tube housing disposed within a medial portion of said outer housing intermediate said air chambers, a partition disposed across said burner tube housing for dividing said burner tube housing into upper and lower zones, a vertically elongated burner tube disposed within and spaced from said burner tube housing, said burner tube extending through said partition in substantially sealed disposition therewith for communicating the upper zone with the lower zone, said burner tube including a plurality of inlet openings at the upper end and an outlet opening at the lower end, a burner having inlet openings and flame generating means disposed within said burner tube adjacent the upper end, each of said air chambers having separate blower means including an inlet communicating with the lower zone of said burner tube housing and an outlet communicating with the respective air chamber for circulating hot air from the lower zone of said burner tube housing into the air chambers, a door means removably secured to said outer housing in spaced relation with each of said wall means for defining a pair of work chambers therebetween for receiving wire fed vertically upwardly from a wire inlet through each work chamber to a wire outlet upper and lower supply conduit means within each of said air chambers communicating the interior of each air chamber with a respective upper and lower portion of one of said work chambers, and a return conduit intermediate each pair of upper and lower supply conduits communicating each work chamber with said upper zone of said tube housing.

2. An oven as recited in claim 1, wherein said door means comprises at least one substantially rectangular body member having vertically extending laterally spaced ends, and means defining a vertically extending recess intermediate said ends, said recess being disposed in spaced disposition to said air chamber wall means to define said work chambers, and means for fastening said ends to said outer housing.

3. An oven as recited in claim 1, including vortex generating means for imparting a swirling movement to the return air supplied to said burner, said vortex generating means comprising a vane housing disposed within said burner tube about said burner, said vane housing including a plurality of space vanes extending from the periphery of said vane housing toward said burner terminating adjacent thereto, the spacing between adjacent means being less adjacent said burner than at the vane housing, said vane housing having a plurality of inlet openings in the periphery thereof whereby air returned to said upper zone is drawn through said burner tube openings and said vane housing openings and imparted with a swirling movement prior to entry into said burner.

4. An oven as recited in claim 3, including means for mounting said burner for vertical adjustment relatively to said vane housing.

5. An oven as recited in claim 1, including an air lock disposed above each of said work chambers for preventing gas within each work chamber from exiting with said wire, each air lock comprising a housing having a wire passageway communicating with said work chamber and through which said wire is fed upon exiting from said work chamber, air directing means within said housing for directing air into said passageway in a direction in opposition to the movement of said wire, air inlet means formed in said housing for receiving air at a higher pressure than the work chamber pressure, and means for dispersing said high pressure air between said inlet means and said air directing means.

6. An oven as recited in claim 1, including means for admitting a controlled supply of ambient air for mixing with the air supplied by said burner tube, and means for exhausting a controlled amount of air from each air chamber to the exterior of said outer housing.

7. An oven as recited in claim 1, including conduit means in each air chamber communicating the respective air chamber with the lower zone of said burner tube housing, valve means in each of said conduit means for selectively opening and closing communication between the burner housing and the respective air chamber for selectively by-passing hot air back to the burner tube housing.

8. An oven as recited in claim 1, including means for selectively communicating said air chambers with each other to balance the pressure therebetween.

9. An oven as recited in claim 1, wherein said supply conduit means each comprise a modular housing fastened to said upstanding wall means, said modular housing having air inlet means opening into said work chamber and air outlet means extending into the respective air chamber.

10. An oven as recited in claim 9, wherein said modular housing includes damper means for throttling the air flow therethrough.

11. An oven as recited in claim 9, wherein inlet means are larger than said outlet means and said housings include air directing vanes for gradually reducing the velocity of the air supplied to said work chambers.

12. An oven as recited in claim 1, wherein said return conduit comprises a modular housing fastened to said upstanding wall and extending intermediate said air chambers into said upper zone of said burner tube housing.

13. An oven as recited in claim 12, wherein said modular housing has a larger air passageway adjacent said upstanding wall than in said burner tube housing and said modular housing includes air directing vanes for gradually increasing the velocity of the air returned to said burner tube housing.

14. An oven as recited in claim 1, wherein each of said air chambers and said burner tube housing comprises a self-supporting modular member disposed on the floor of said oven.

* * * * *